United States Patent [19]

Toyota

[11] Patent Number: 4,819,852

[45] Date of Patent: Apr. 11, 1989

[54] AUTOMATIC FASTENER ASSEMBLING APPARATUS

[75] Inventor: Sumio Toyota, Toyama, Japan

[73] Assignee: Yoshida Kogyo K. K., Tokyo, Japan

[21] Appl. No.: 72,751

[22] Filed: Jul. 13, 1987

[30] Foreign Application Priority Data

Jul. 16, 1986 [JP] Japan ..... 61-109028[U]

[51] Int. Cl.[4] ..... A41H 37/04

[52] U.S. Cl. ..... 227/8; 227/15

[58] Field of Search ..... 227/8, 15, 18, 16, 30, 227/31; 29/243.5, 216

[56] References Cited

U.S. PATENT DOCUMENTS

| | | | |
|---|---|---|---|
| 3,292,837 | 12/1966 | Heil et al. | 227/16 |
| 4,485,541 | 12/1984 | Seki | 227/8 X |
| 4,598,468 | 7/1986 | Yoshieda | 227/8 X |
| 4,606,487 | 8/1986 | Douri | 227/8 |

*Primary Examiner*—Frank T. Yost
*Assistant Examiner*—James L. Wolfe

[57] ABSTRACT

In an automatic fastener assembling apparatus, a device for actuating a drive to initiate the lowering of a punch includes a pivotable actuating lever having at its front end portion a lower sloping edge and at its rear end portion a projection the front end portion being normally urged upwardly by an extension spring. A safety cover is connected to the lever by a leaf spring normally defining with the sloping edge a triangular space. At the first stage of double-stage stepping of a foot pedal, the front end portion of the lever is lowered against the bias of the extension spring until the safety cover rests on a die. At the second stage, the front end portion is further lowered against the bias of both the extension and leaf springs to reduce the triangular space, thus causing the projection to depress a plunger of a microswitch for the drive.

2 Claims, 4 Drawing Sheets

AUTOMATIC FASTENER ASSEMBLING APPARATUS

BACKGROUND OF THE INVENTION

1. Field of the Invention:

The present invention relates to an apparatus for automatically assembling a pair of fastener elements of a garment fastener, such as a snap button, a hook-and-eye fastener or an ornament, with a garment fabric disposed between the two fastener elements. More particularly, the invention relates to such an automatic fastener assembling apparatus of the type in which a drive for lowering a punch toward a die is actuated by stepping a foot pedal.

2. Description of the Prior Art:

U.S. Pat. No. 3,292,837, issued Dec. 20, 1966, discloses an automatic fastener assembling apparatus of the type mentioned above. According to this prior apparatus, an actuating means for the drive to lower the punch generally includes a channel-shaped cover pivotally mounted on a frame by a pivot, and an inverted L-shaped lever pivotally connected at its rear end to the pivot and at its front end to a garment presser. The front end of the cover is normally urged upwardly by an extension spring. A compression spring is mounted between the cover and the lever so as to normally urge the lever away from the cover. The cover is operatively connected to a foot pedal via a pull rod. As the foot pedal is stepped to pull the front end of the cover downwardly against the bias of the extension spring, the front end of the lever is lowered under the bias of the compression spring to cause the garment presser to. press the garment fabric against the die. As the foot pedal is further stepped, the front end of the cover is further lowered against the bias of the extension spring and also against the bias of the compression spring. As a result, the rear end of the cover is raised to depress a plunger of a microswitch, thus energizing the drive to lower the punch. However, this prior apparatus is disadvantageous in that the actuating means requires a relatively large number of components, thus making the apparatus complex in construction and hence expensive to manufacture.

SUMMARY OF THE INVENTION

It is therefore an object of the present invention to provide an automatic fastener assembling apparatus in which an actuating means is composed of a reduced number of components, thus making the apparatus simple in construction and hence inexpensive to manufacture.

According to an automatic fastener assembling apparatus of the present invention, a means for actuating a drive to lower a punch toward a die comprises a pivotable actuating lever, an extension spring normally urging a front end portion of the actuating lever upwardly, and a leaf spring connecting a safely cover to a lower level edge of the actuating lever. The front end portion of the actuating lever has at its lower side a sloping edge normally defining with the leaf spring a triangular space. At the first stage of double-stage stepping of the foot pedal, the front end portion of the actuating lever is lowered until the safety cover rests on the die under the bias of the leaf spring. At the second stage of double-stage stepping of the foot pedal, the front end portion of the actuating lever is further lowered so as to reduce the width of the space between the sloping edge and the leaf spring as the latter yields upwardly, causing a projection at the rear end of the actuating lever to depress an actuator of a switch.

Many other advantages, features and additional objects of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

Figure 1:
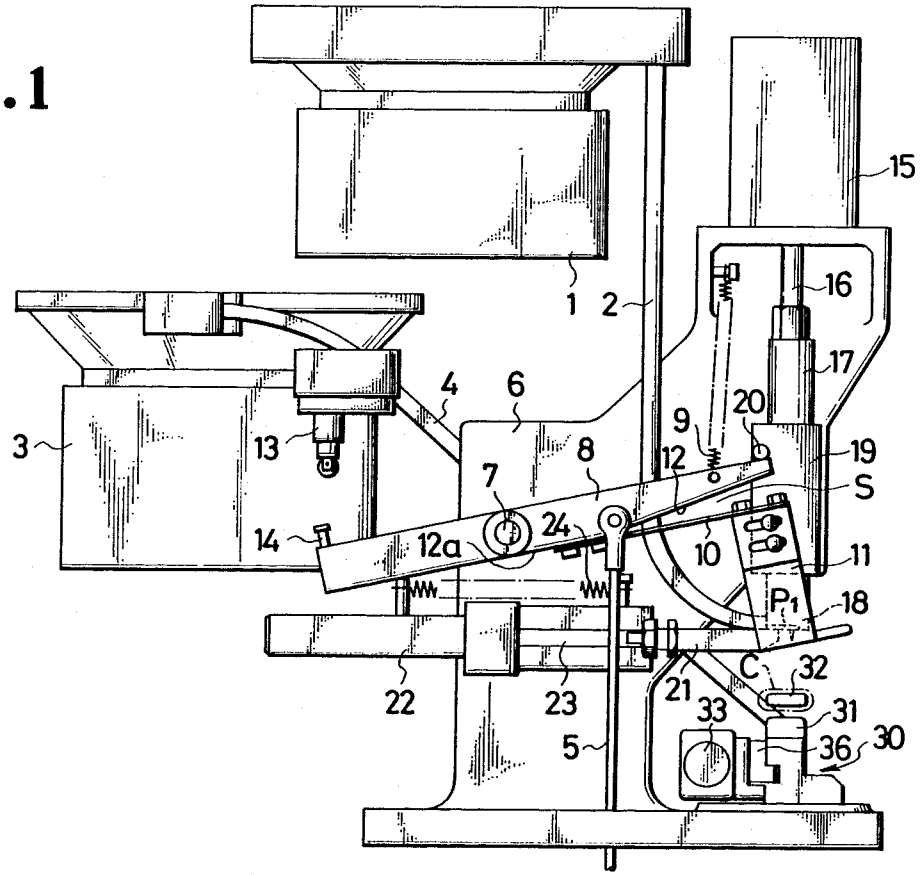
FIG. 1 is a fragmentary front elevational view of an automatic fastener assembling apparatus embodying the present invention.
Figure 2:
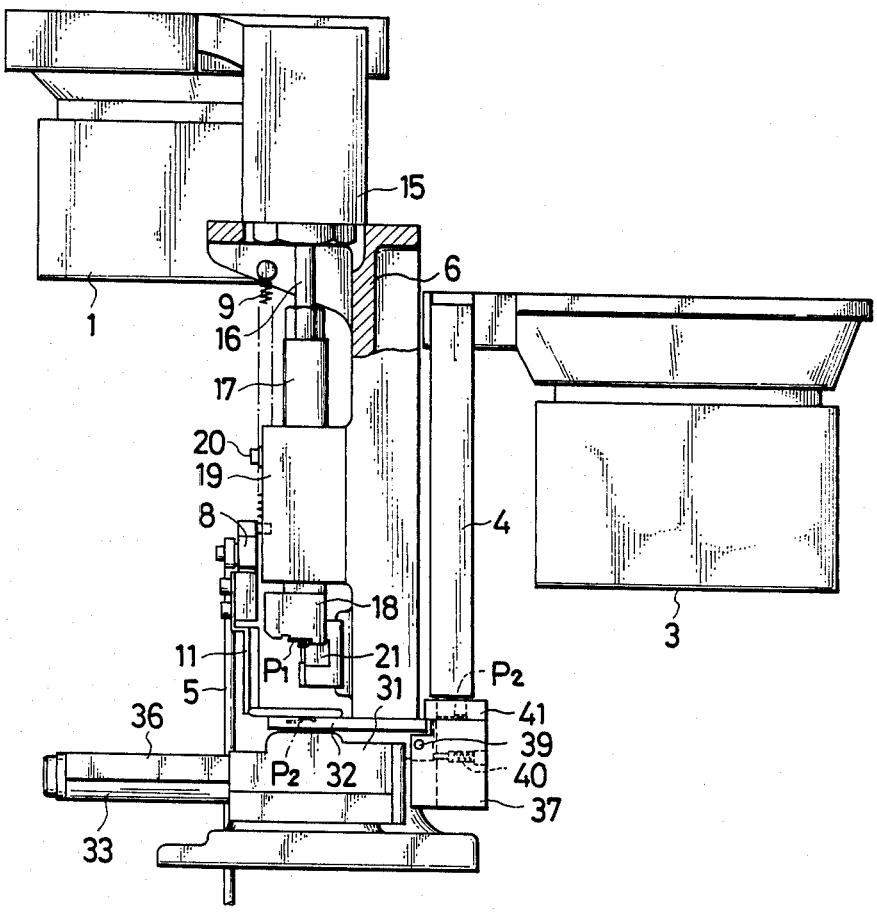
FIG. 2 is a side elevational view, partially in cross section, of FIG. 1, showing a safety cover in lowered position.
Figure 3:
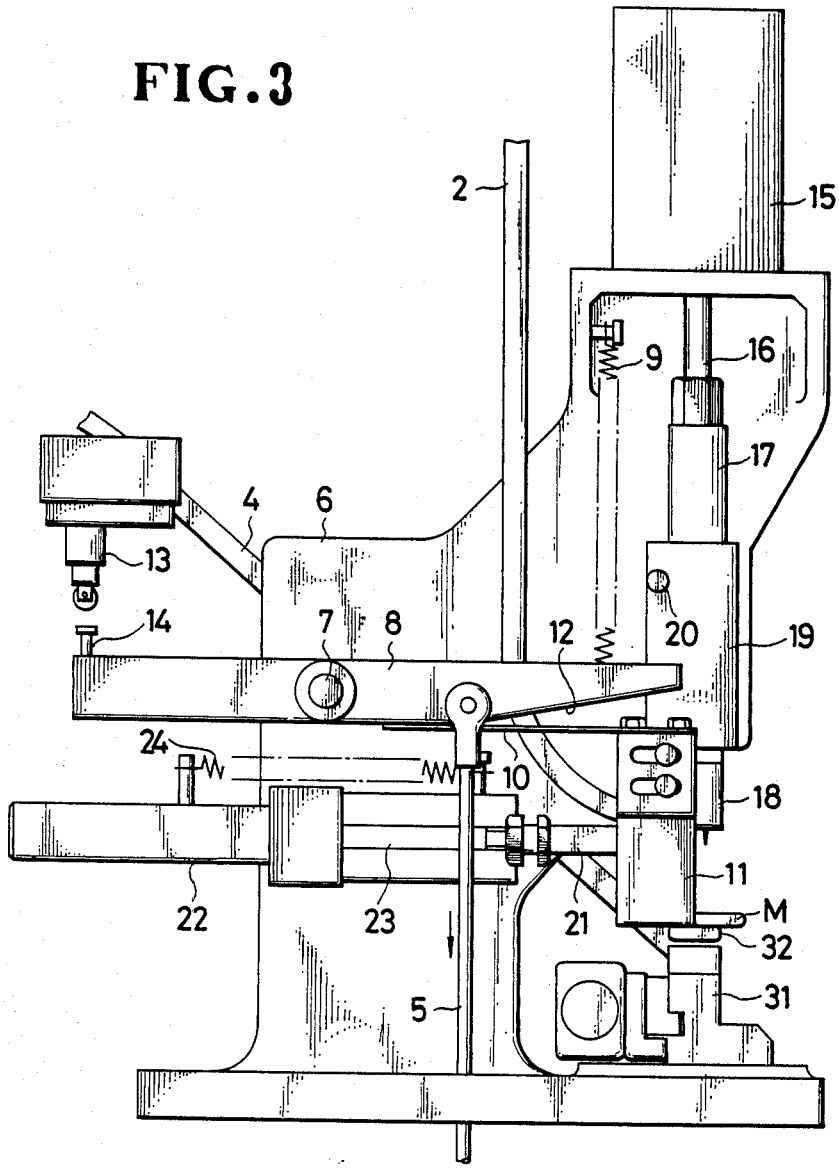
FIG. 3 is a front elevational view of a portion of FIG. 1, showing the safety cover in lowered position.

FIGS. 1 through 3 show an automatic fastener assembling apparatus for joining a pair of first and second fastener elements P1, P2 together in clenched condition with a garment fabric C sandwiched therebetween. In the illustrated embodiment, the first and second fastener elements P1, P2 comprise a hook and a hasp, respectively. The hasp has at least two apertures, and the hook has at least two spikes projecting from a hook body for piercing through the garment fabric C and also for being inserted through the apertures in the hasp and clenched at the underside of the hasp.

The apparatus comprises an upper or punch unit, a lower or die unit 30, a first chute 2 for feeding successive first fastener elements P1 from a first feeder 1 toward the upper unit, and successive second chute 4 for feeding a second fastener elements P2 from a second feeder 3 toward the lower unit 30.

The apparatus also has a pusher 21 for supplying the first fastener element P1 from an outlet (lower end) of the first chute 2 to the upper unit. The pusher 21 is connected to a distal end of a piston rod 23 of an air cylinder 22 horizontally slidably supported on a frame 6. An extension spring 24 is mounted between the frame 6 and the air cylinder 22 to normally urge the the latter rightwardly to such a position that a front end of the pusher 21 is normally disposed below the upper unit as the air cylinder 22 is de-energized. When the air cylinder 22 is energized upon actuation of a microswitch 13 (described below) located at a fixed position, the piston rod 23 is shrunk to retract leftwardly from the position of FIG. 1 against the bias of the spring 24 so as not to obstruct the downward movement of the upper unit.

The upper unit includes a guide 19 fixed to the frame 6, a ram 17 vertically reciprocable on the guide 19, and a punch 18 supported on a lower end of the ram 17. The ram 17 is connected at an upper end thereof to a piston rod 16 of an air cylinder 15 fixed to the frame 6. When the air cylinder 15 is energized upon actuation of the microswitch 13 (described below), the piston rod 16 is extended to lower the ram 17 and hence the punch 18.

The apparatus also has a mechanism for actuating the switch 13. The mechanism includes an actuating lever 8 pivotally mounted on the frame 6 by a pivot 7, and a pull rod 5 connected at its lower end to a foot pedal (not shown) and at its upper end to the actuating lever 8. The connection of the pull rod 5 with the actuating lever 8 is such that when the foot pedal is stepped, the actuating lever 8 is pivotally moved clockwise (FIG. 1) about the pivot 7 against the bias of an extension spring 9. The spring 9 is mounted between the frame 6 and a front or right end portion of the actuating lever 8 to normally urge the front end portion of the actuator lever 8 upwardly. The upward movement of the front end portion of the actuating lever 8 is restricted by a stop 20 mounted on an upper portion of the guide 19. At its rear or left end portion, the actuating lever 8 has a substantially upwardly directed projection 14 that is engageable with an actuator or plunger of the microswitch 13 to actuate the microswitch 13 when the actuating lever 8 is pivotally moved clockwise (FIG. 1) by the action of the foot pedal (not shown) and hence the pull rod 5.

The front end portion of the actuating lever 8 is tapered and has at its lower side a sloping edge 12. A leaf spring 10 is fixed at its rear or left end to a lower level edge 12*a* of the actuating lever 8 and extends in a free form as an extention of the level edge 12*a*, thus defining with the sloping edge 12 a triangular space S. The leaf spring 10 has a yield strength higher than that of the extension spring 9. A safety cover 11 is mounted on a front or right end of the leaf spring 10 perpendicularly thereto.

Figure 4:
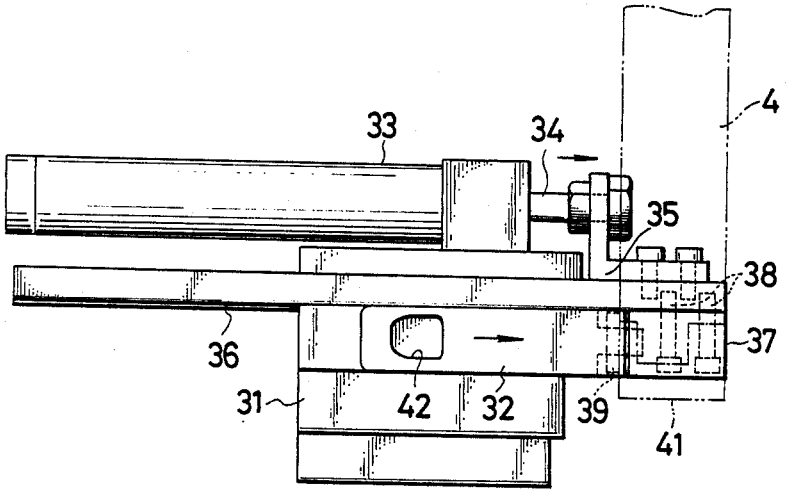
FIG. 4 is a plan view of a lower unit.
Figure 5:
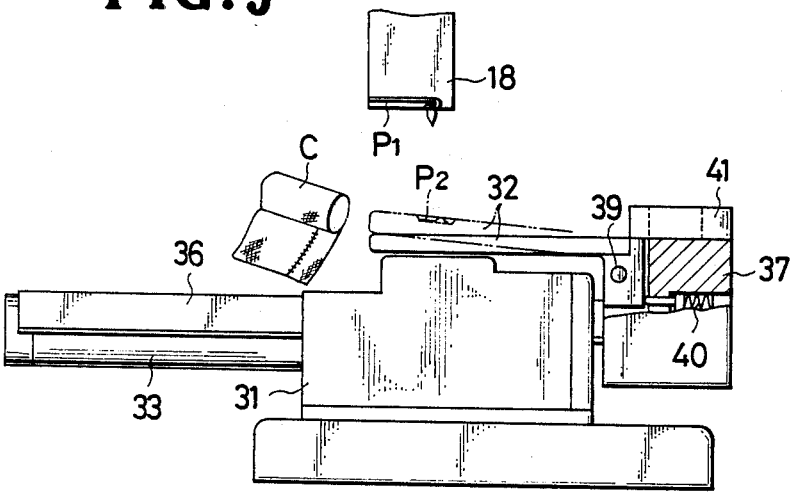
FIG. 5 is a front elevational view, partially in cross section, of FIG. 4.

The lower unit 30 includes a support block 31 fixed to the frame 6, a die 32 slidably supported on the support block 31, a horizontal air cylinder 33 fixed to the support block 31, a guide member 36 fixed to a piston rod 34 of the air cylinder 33 through the medium of a generally L-shaped connector 35, and a die holder 37 fixed to the guide member 36 by a pair of threaded bolts 38, 38 (FIG. 4). The die 32 is pivotally connected to the die holder 37 by a pin 39. A compression spring 40 acts between the die holder 37 and the die 32 so as to normally urge the latter to an inclined position (phantom lines in FIG. 5) in which its distal end is raised. When the piston rod 34 of the air cylinder 33 is extended upon energization of the air cylinder 33, the guide member 36 with the die 32 slides on the support block 31 until a fastener supporting seat 42 in the die 32 arrives at a generally C-shaped (as viewed in plan) fastener holding member 41 which is disposed at the lower end of the second chute 4 for receiving the successive second fastener elements P2 one at a time. After a second fastene element P2 is transferred from the fastener holding member 41 to the fastener supporting seat 42, the die 32 is returned to a fastener joining position where the fastener supporting seat 42 with the second fastener element P2 is vertically aligned with the punch 18. Thus the successive second fastener elements P2 are automatically supplied to the die 32.

The operation of the apparatus will now be described with reference to FIGS. 1 thorugh 3.

In FIG. 1, as the non-illustrated foot pedal is depressed, the pull rod 5 is pulled downwardly to cause the actuating lever 8 to pivot clockwise about the pivot 7 against the spring 9 so that the inclined die 32 is depressed by the lower end of the safely cover 11 as shown in FIGS. 2 and 3, at which time the actuating lever 8 assumes a substantially horizontal posture with the projection 14 spaced from the plunger of the microswitch 13 and also with the triangular space S between the sloping edge 12 and the leaf spring 10. Then a garment fabric C is registered with a register mark M attached to the safety cover 11.

With the garment fabric C thus placed in correct position, as the foot pedal is further depressed to pull the pull rod 5 downwardly from the position of FIGS. 2 and 3, the actuating lever 8 is pivotally moved clockwise from the horizontal position against both the bias of the extension spring 9 and the bias of the leaf spring 10 to reduce the width of the space S as the leaf spring 10 yields upwardly. As a result, the projection 14 at the left end of the actuating lever 8 is raised to depress the plunger of the microswitch 13 to actuate the microswitch 13, energizing the air cylinder 15.

As the ram 17 is lowered upon energization of the air cylinder 15, the punch 18 is moved toward the die 32 to join the first and second fastener members P1, P2 together in clenched condition with the garment fabric C sandwiched between the two fastener elements. Thus safety during the assembling of the fastener members is guaranteed by two-stage actuation of the foot pedal.

According to the apparatus thus constructed, since two-step pivotal movement of the actuating lever 8 as pulled downwardly by the double-stage stepping of the foot pedal is accomplished simply by providing the sloping edge 12 at the underside of the front end of the actuating lever 8 and by using the extension spring 9 and the leaf spring 10, it is possible to minimize the number of parts of the actuating means without any risk of impairing safety so that the apparatus can be manufactured easily and inexpensively.

Although various minor modifications may be suggested by those versed in the art, it should be understood that I wish to embody within the scope of the patent warranted thereon, all such embodiments as reasonably and properly come within the scope of my contribution to the art.

What is claimed is:

1. An apparatus for automatically assembling a pair of fastener elements of a garment fastener with a garment fabric sandwiched therebetween, comprising:

(a) a frame;

(b) a pair of vertically aligned upper and lower units supported by said frame for receiving the respective fastener elements, said lower unit including a die, said upper unit including a ram reciprocably supported by said frame and having a punch movable, in response to reciprocating movement of said ram, toward and away from said die to join the two fastener elements together;

(c) an air cylinder operatively connected with said ram for moving the latter vertically;

(d) a switch operatively connected with air cylinder for energizing the latter to initiate the lowering of said ram;

(e) an acutating lever pivotally mounted on said frame and having a tapered front end portion and a rear end portion engageable with an actuator of said switch, said tapered end portion having a lower sloping edge;

(f) an extension spring normally urging said front end portion of said actuating lever upwardly;

(g) a leaf spring fixedly connected at its rear end to a lower level edge of said actuating lever and resiliently supporting at its front end a safety cover, said leaf spring defining in a free form with said lower sloping edge a triangular space, said leaf spring having a yield strength higher than the yield strength of said extension spring; and (h) a pull rod connected at its upper end to said front end portion of said actuating lever and at its lower end to a foot pedal.

2. An apparatus according to claim 1, said leaf spring extending in its free form as an extension of said lower level edge of said actuating lever.

* * * * *